United States Patent [19]

White et al.

[11] 4,060,942

[45] Dec. 6, 1977

[54] HOOD ADJUSTING APPARATUS

[75] Inventors: William Page White; Kenneth Robert Hawkins, both of Cincinnati, Ohio

[73] Assignee: Cincinnati Milacron, Inc., Cincinnati, Ohio

[21] Appl. No.: 680,274

[22] Filed: Apr. 26, 1976

[51] Int. Cl.[2] ..... B24B 55/04

[52] U.S. Cl. ..... 51/268; 51/165.87

[58] Field of Search ..... 51/268, 165 R, 165.87, 51/165.88

[56] References Cited

U.S. PATENT DOCUMENTS

| | | | |
|---|---|---|---|
| 3,638,364 | 2/1972 | Grove | 51/269 |
| 3,744,189 | 7/1973 | Kakumu | 51/268 |
| 3,748,788 | 7/1973 | Koppenwallner | 51/165.87 |
| 3,835,595 | 9/1974 | Oshima | 51/268 |

*Primary Examiner*—Harold D. Whitehead

*Attorney, Agent, or Firm*—Thomas M. Farrell

[57] ABSTRACT

A grinding machine wheel guard hood adjusting apparatus, wherein a wheel guard hood is swingably attached to a wheel guard at one end so that the opposite end of the hood may be swung into close proximity with a grinding wheel circumference. A pivot joint is provided on the wheel guard, having its axis parallel to the hood swing axis, and a housing is affixed to the first pivot joint. A screw is rotatably carried in the housing and a stepping motor is carried on the housing to drive the screw in rotatable directions. A second pivot joint, having its axis parallel to the first pivot joint axis is provided on the swingable hood at a point away from the swing axis, and a nut is affixed to the second pivot joint. The nut and screw are threadably engaged, thus providing a variable link between the two pivot points so that as the screw is rotatably actuated, the nut and second pivot point is powered movably in relation to the first pivot joint, thus swinging the hood to desired positions relative to the wheel circumference. Where a wheel dressing device is motor powered by signal means from a motor control, the hood power motor may be controlled from the same motor control source so that the hood may be moved into close proximity with the wheel as the wheel is dressed.

1 Claim, 3 Drawing Figures

MOTOR CONTROL

HOOD ADJUSTING APPARATUS

BACKGROUND OF THE INVENTION

In a cylindrical grinding machine, having a rotatable grinding wheel carried in a wheel head and surrounded by a wheel gaurd, a wheel gaurd hood is often employed to act as an adjustable gaurd, to take up the voids between the grinding wheel and the relatively fixed wheel gaurd as the grinding wheel changes size due to wheel wear and dressing cycles. The wheel gaurd hood is most generally swingably attached to a swing axis at the the top of the wheel gaurd and is secured to the wheel guard by both the swing pivot stud and a bolt passing through the hood at a point distal from the swing axis. The bolt passes through a slot in the hood, which slot is arcuately formed about the swing axis, so that as the bolt is loosened, the hood may be pivoted and reclamped by the bolt. The hood is usually adjusted by an operator having to manually unclamp, reposition and clamp the hood.

The hood tends to prevent coolant from escaping from the periphery of the grinding wheel, splashing where undesired, and further, the hood tends to entrap wheel fragments which may occur in the event of wheel breakage. Naturally, since the wheel gaurd is a fixed structure sized to carry the maximum grinding wheel, the "voids", or clearances, between the wheel and the wheel gaurd, become accentuated as the wheel is reduced in size, thus intensifying any tendencies toward occurrence of the aforementioned hazards.

Since hoods are generally adjusted by the machine user in manual fashion, they are not in the closest proximity to the wheel at all times as they are only adjusted periodically while the wheel is reducing in size continually. Thus, a potential hazard may be permitted to exist by the machine user by his not adjusting the hood as often as needed.

Purely mechanical means for automatically adjusting the hood in relation to wheel head position on the base, is not too practical for a machine which must grind a variety of part sizes. That is, a mechanical system could possibly be devised where all the system parameters are fixed, including the part size. For greatest adaptability, however, applicant has obviated many of the difficulties inherent in the prior art devices by his novel design which employs a motor means for automatically powering a wheel gaurd hood into close proximity with a grinding wheel circumference. In addition, many state of the art machines employ wheel dressing means having automatic compensation devices which may be powered from a motor control source. Applicant's invention provides a system which may receive like pulses from a motor control source at time of wheel dressing, providing a contemporaneously moveable wheel guard hood in relation to a dressed wheel, or in the alternative, the wheel guard hood may be configured so that its point which is nearest the wheel, may be powered from a pivot point which is elsewhere on the hood, and thus it may be desirable to move the hood by motor signals means in a predetermined ratio to a wheel dressing motor means.

It is therefore an object of the present invention to provide an automatically controlled wheel hood adjusting apparatus, which is capable of being powered from a motor control source in ratio to the signals of a wheel dressing apparatus.

SUMMARY OF THE INVENTION

A grinding machine wheel guard hood adjusting apparatus is provided where the wheel guard hood is swingably attached to a wheel guard so that the hood may be swung into close proximity with the wheel circumference, and a first pivot joint is provided on the wheel guard and a second pivot joint is provided on the hood where the pivot joints have their axes parallel to the swing axis of the hood. An adjustable link means is provided between the two pivot joints comprising a housing containing a rotatable screw which is affixed to the first pivot joint and a nut which is affixed to the second pivot joint, wherein the nut and screw are threadably engaged. A motor power means is provided on the housing of the first pivot joint to rotate the screw in command to a motor control signal to correspond to changes in wheel diameter.

DESCRIPTION OF THE PREFERRED EMBODIMENT

Figures 1, 2, 3:
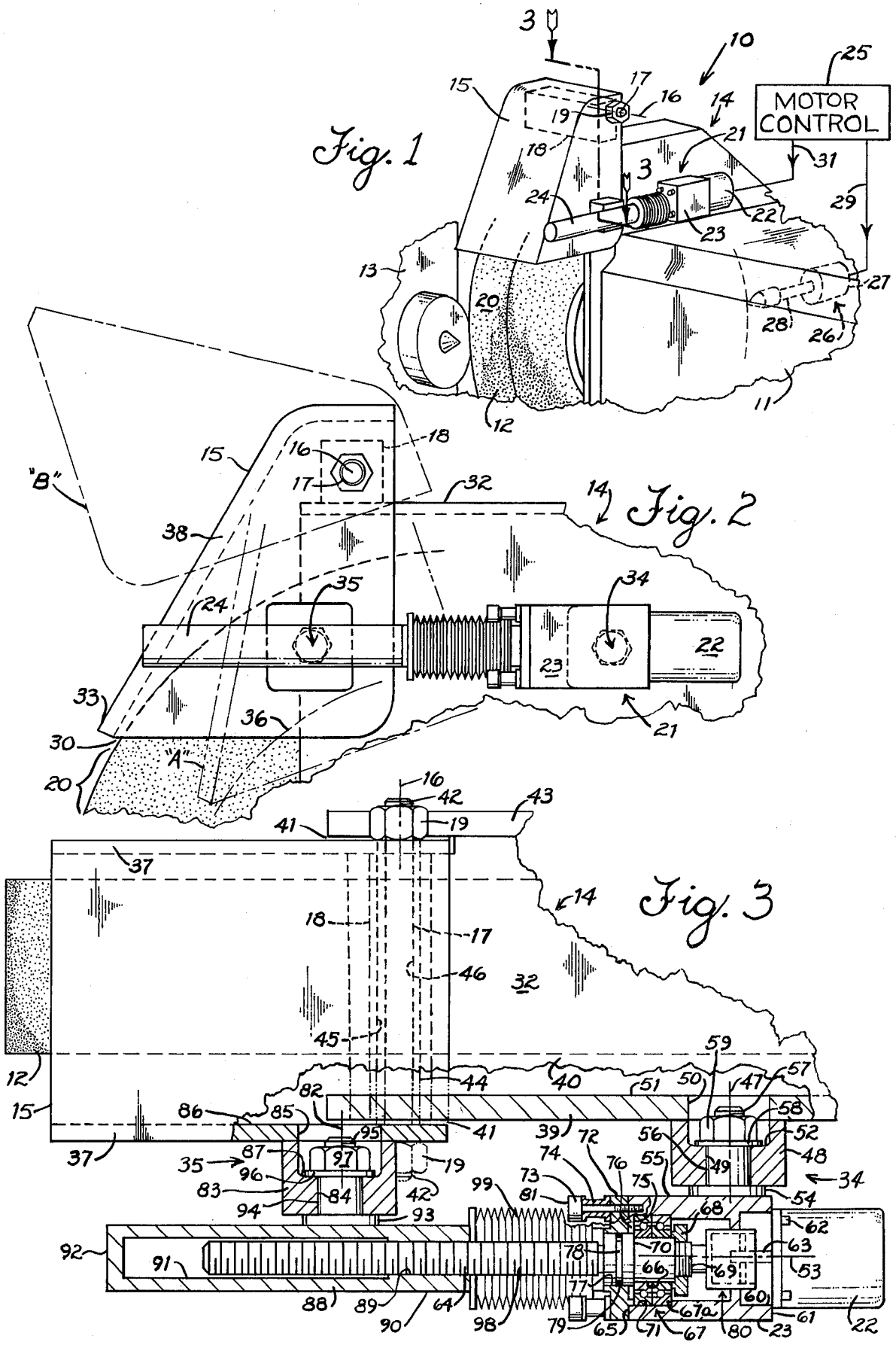
FIG. 1 is a perspective view of a grinding machine having an automatic hood adjusting apparatus.
FIG. 2 is a side elevation of the hood adjusting apparatus of FIG. 1.
FIG. 3 is a plan section taken along the line 3—3 of FIG. 1.

Turing now to the drawings and particularly to FIG. 1 thereof, there is shown in perspective, a grinding machine 10 having a wheelhead 11 which carries a rotatable grinding wheel 12 wherein the wheelhead 11 is movable with respect to a base portion 13, and further wherein, a wheel guard 14 is provided on the wheelhead 11, in a fixed relationship to said wheelhead 11. A grinding wheel guard hood 15 is shown swingably attached to the wheel guard 14 by means of a swing axis 16 established by a stud 17 passing through the topmost portion of the hood 15 and passing transversely through the swing block 18, which is affixed to the wheel guard 14. The hood 15 is secured by nut means 19 on the swing stud 17.

The hood 15 is pivotable on the swing axis 16 so that the hood 15 may be swung into close proximity with the peripheral surface 20 of the grinding wheel 12, and as the grinding wheel 12 is reduced in diameter, the hood 15 may follow and maintain its close proximity.

Accordingly, a hood adjusting apparatus 21 is shown, having a motor means 22 affixed to a housing 23 which is pivotally connected to the wheel guard 14. A nut 24 is shown pivotally connected to the hood 15, at a point distal to the swing axis 16. As the motor 22 receives a signal from a motor control 25, the pivotable nut 24 on the hood 15 is moved with respect to the housing 23, thus swinging the hood 15 about the swing axis 16.

A wheel dresser unit 26, having a motor 27 to advance the diamond unit 28 for dressing the wheel 12 at predetermined intervals, is shown receiving a signal on the line 29 from the motor control 25. When incremental movement of the hood proximity point 30 of the wheel surface 20 and hood 15 closely approximates the incremental dresser advance, the two motor control signals may be tied together and be received commonly. However, in certain arrangements, where the proximal position of the hood 15 relative to the wheel surface 20 is controlled by the hood adjusting apparatus 21 affixed to the wheel hood 15 at some point such as to require a ratio of power signal means, the signal means from the motor control 25 to the hood adjusting apparatus 21 may be received on line 31 in a predetermined ratio to the signal means to the dresser apparatus 26.

FIG. 2 depicts a side elevation of the hood adjusting apparatus 21 of FIG. 1, illustrating that the hood 15 is swingably attached about the swing axis 16 of the swing stud 17 which passes through both the hood 15 and the swing block 18 which is affixed to the top 32 of the wheel guard 14. The distal end 33 of the wheel hood 15 is kept in close proximity to the wheel surface 20, at a point 30 of minimal clearance. The first pivot joint 34 is shown on the wheel guard 14, and the housing 23 is shown having the motor means 22 attached thereto. The second pivot joint 35 is shown on the wheel hood 15, affixed to the nut 24 of the apparatus 21. The phantom position "A", indicates that the wheel guard hood 15 has been powered to a position in close proximity with a worn wheel circumference 36, and at all intermediate points thereto, while the phantom position "B", indicates that the hood 15 may be powered in a reverse direction to raise it for changing of wheels 12.

FIG. 3 is a plan section taken through the hood adjusting apparatus 21, illustrating that the hood 15 is comprised of side plates 37 which are joined by the center plate 38 to surround the wheel 12. The wheel guard 14 is comprised of a side plate 39, side cover 43, and a top plate 40 and is dimensioned to such width that the hood plates 37 straddle the wheel guard plates 39,40, at the front portion 41. A swing block 18 is shown affixed to the top 32 of the wheel guard 14, and a swing stud 17 passes through the side plates 37 of the hood 15, and through the swing block 18. The ends 42 of the swing stud 17 are threadably engaged with lock nuts 19 to prevent axial movement of the swing stud 17 relative to the hood 15. A tubular spacer 44 is provided, passing through a suitable bore 45 in the swing block 18, and having a center hole 46 adapted to fit closely on the swing stud 17, thereby preventing overclamping of the side walls 37 and deflection thereof.

The first pivot joint 34 is shown on the wheel guard 14, having its axis 47 parallel to the swing axis 16. The joint 34 is comprised of a collar 48 which is affixed to the wheel guard 14, and the collar 48 has a bore 49 therethrough and a counterbore 50 extending from the inner surface 51 of the guard plate 39 into the collar 48 terminating at a bottom surface 52 therein. A housing 23 is provided, having a central axis 53 therethrough, and the transverse pivot axis 47 extends coaxially through the first pivot joint. A spacer diameter 54 is machined on the side 55 of the housing 23, and a pilot 56 is provided which bears in close-fitting relationship with the bore 49 through the collar 48. The pilot 56 extends through the bore 49 to the counterbore 50, where a reduced threaded section 57 is provided on the pilot 56. A washer 58 is placed over the threaded section 57, bearing on the bottom surface 52 of the counterbore 50, and a locknut 59 is received on the threaded section 57, to such fit that axial movement of the pilot 56 relative to the wheelguard 14 is prevented, yet rotary movement between the two 56, 14 is permitted.

The housing 23 contains a clearance bore 60 at the rear end 61, coaxial with the central housing axis 53, and a motor power means 22 is affixed to the rear end 61 by screws 62, allowing the motor shaft 63 to extend into the housing 23. A power screw 64 is adapted to the front 65 of the housing 23, where a bearing diameter 66 is provided on the screw 64, which carries a set of bearings 67 which are retained to the screw 64 by means of a locknut 68 threadably received on the inner end 69 of the screw 64, clamping the bearings against a shoulder diameter 70 which is provided on the screw 64. The bearings 67 are held in a bearing bore 71 which is provided in the front 65 of the housing 23, and are retained therein by means of a bearing retainer 72 which is secured to the housing 23 by screws 73 passing through tubular spools 74. The bearing retainer 72 has a pilot 75 which bears in the bore 71, and a relief 76 is machined in the face of the bearing retainer 72 so that the retainer 72 bears only on the outer races 67*a* of the bearing 67. A bore 77 is provided through the bearing retainer 72, which is in close-fitting relationship to the shoulder diameter 70 on the screw 64. A groove 78 is provided about the shoulder diameter 70 which contains a seal ring 79 to prevent contaminants from entering the housing 23. The inner end 69 of the screw 64 is adapted to receive a commercial speed reducer 80, such as the Harmonic Drive Reducer, available from USM Corporation, and the speed reducer 80 couples the motor shaft 63 to the screw 64 in such fashion that motor input motion, through a fixed ratio, provides output motion to the screw 64.

The spools 74 which are interposed between the screw head 81 and the bearing retainer 72 are energy absorption devices, wherein the spools 74 are comprised of a frangible design and material, described in detail in U.S. Pat. No. 3,638,364. The spool 74 essentially is a deformable spacer which will absorb energy as the spool is collapsed in an axial direction. Specifically, in this apparatus, since the power screw 64 may be pulled in an axial direction relative to the housing 23, in the event of a wheel breakage, the screw 64, bearings 67, and bearing retainer 72 may be moved axially, thereby deforming the energy absorbing spools, 74 to dissipate the energy of a broken wheel fragment.

The second pivot joint 35 is provided on the hood 15, and the pivot joint axis 82 is parallel to the first pivot joint axis 47 and the swing axis 16. A collar 83 is affixed to the side plate 37 of the wheel guard hood 15, and a bore 84 is provided therethrough, coaxial with the pivot axis 82. A counterbore 85 is provided from the inner surface 86 of the side plate 37, extending through the side plate 37 and into the collar 83, terminating at a bottom surface 87. A tubular nut 88, having threads 89 at the one end 90, and a relief 91 provided therein to the end 92 of the nut 88, is provided where the nut 88 is affixed to a transverse spacer diameter 93 and the spacer diameter 93 reduces to a closefitting pilot 94 which bears in the bore 84 of the collar 83. The pilot 94 extends through the collar 83, and reduces to a threaded portion 95. A washer 96 is placed over the threaded portion 95 and a locknut 97 is received on the threaded portion 95 to such fit as to restrict axial movement of the pilot 94, yet provide relative rotation to occur between the pilot 94 and the collar 83. The screw 64 has a threaded portion 98 which extends from the shoulder diameter 70 through the nut 88 wherein it is threadably engaged. A convoluted, extensible boot 99 is adapted to the nut 88 and retainer 72 so as to provide protection for the screw 64.

Therefore, as the motor means 22 is actuated, the screw 64 will be rotated in a predetermined ratio thereto, and the nut 88 which is restrained from relative rotation, will be powered axially on the threaded portion 98 of the screw 64, thus changing the center distance between the first and second pivot joints 47, 82, creating an adjustable link between the joints 47, 82 and moving the wheel guard hood 15 in response to changes in wheel size.

What is claimed is:

1. In a grinding machine having a wheel guard enclosing a grinding wheel, and a wheelguard hood swingable about a swing axis on said wheelguard to move said hood into close proximity with a grinding wheel circumference, an improved hood adjusting apparatus comprising:

a. a first pivot joint on said wheelguard;

b. a second pivot joint on said hood, distally located from said swing axis, wherein first and second pivot joint axes are parallel to said swing axis;

c. a screw and nut system, relative rotatable, wherein said screw is axially secured to said first pivot joint and said nut is axially secured to said second pivot joint so as to provide an adjustable link connecting said pivot joints;

d. reversible power means to provide alternate intermittent and continuous relative rotation to said screw and nut system to adjust said hood to correspond to changes in wheel diameter; and e. means to power said hood about said swing axis to a wheel access position wherein a grinding wheel may be interchanged with a grinding wheel spindle, without interfering with said hood adjusting apparatus.

* * * * *